US007708303B1

(12) United States Patent
Inge

(10) Patent No.: US 7,708,303 B1
(45) Date of Patent: May 4, 2010

(54) PRODUCT FOR TRAVERSING SNOW

(75) Inventor: Steven Inge, Corona, CA (US)

(73) Assignee: Yankee SnowBoards LLC, Corona, CA (US)

( * ) Notice: Subject to any disclaimer, the term of this patent is extended or adjusted under 35 U.S.C. 154(b) by 538 days.

(21) Appl. No.: 11/163,440

(22) Filed: Oct. 19, 2005

(51) Int. Cl.
*A63C 5/03* (2006.01)

(52) U.S. Cl. ..... 280/609; 280/610; 280/14.21

(58) Field of Classification Search ..... 280/607, 280/608, 609, 610, 14.21, 14.22
See application file for complete search history.

(56) References Cited

U.S. PATENT DOCUMENTS

| | | | | | |
|---|---|---|---|---|---|
| 3,771,805 | A | * | 11/1973 | Ishida | 280/610 |
| 4,097,061 | A | * | 6/1978 | Dietlein | 280/607 |
| 4,412,687 | A | | 11/1983 | Andree | 280/610 |
| 4,523,772 | A | | 6/1985 | Arnsteiner | 280/610 |
| 4,556,237 | A | | 12/1985 | Meatto et al. | 280/610 |
| 4,634,140 | A | * | 1/1987 | Stroi | 280/610 |
| 4,671,529 | A | | 6/1987 | LeGrand et al. | 280/610 |
| 4,679,814 | A | | 7/1987 | Meatto et al. | 280/610 |
| 4,767,369 | A | * | 8/1988 | Snyder | 441/68 |
| 5,005,853 | A | | 4/1991 | Lampl | 280/610 |
| 5,238,260 | A | | 8/1993 | Scherubl | 280/610 |
| 5,441,305 | A | | 8/1995 | Tabar | 280/809 |
| 5,687,983 | A | | 11/1997 | Feketa et al. | 280/609 |
| 5,759,664 | A | | 6/1998 | Chisnell | 428/109 |
| 6,073,956 | A | * | 6/2000 | Zemke et al. | 280/610 |
| 6,105,991 | A | | 8/2000 | Dodge et al. | 280/610 |
| 6,131,939 | A | * | 10/2000 | Fels | 280/601 |
| 6,345,834 | B1 | | 2/2002 | Bianchini et al. | 280/602 |
| 6,382,658 | B1 | | 5/2002 | Stubblefield | 280/609 |
| 6,502,850 | B1 | | 1/2003 | Schaller et al. | 280/610 |
| 6,520,530 | B1 | | 2/2003 | Dodge et al. | 280/610 |
| 6,588,772 | B2 | * | 7/2003 | Smith et al. | 280/14.21 |
| 2001/0022439 | A1 | | 9/2001 | Andrus et al. | 280/610 |
| 2002/0089149 | A1 | | 7/2002 | Barbieri et al. | 280/609 |
| 2002/0105165 | A1 | | 8/2002 | DeRocco | 280/608 |
| 2003/0098557 | A1 | | 5/2003 | Barbieri et al. | 280/14.21 |

FOREIGN PATENT DOCUMENTS

| | | | |
|---|---|---|---|
| EP | 2804612 | A1 * | 8/2001 |
| FR | 688585 | A1 * | 12/1995 |

* cited by examiner

*Primary Examiner*—Frank B Vanaman
(74) *Attorney, Agent, or Firm*—Law Office of Ken Dallara; Ken Dallara

(57) ABSTRACT

Though the sport of snowboarding is not new, it has taken many years to understand the specific characteristics which are required for making snowboards. There is better understanding of the dynamic bending properties needed for current riders, especially for the competition driven rider whose demands require boards with different tip, tail and middle characteristics. Early snowboard designers understood the use of snowboards as articles for gliding down a snow covered slope making long curving turns, where tips and tails would be as stiff as the middle core. But now, the boards are jumped into the air, launching from half pipes edges and sliding down steel rails, requiring different flex contours. Snowboards are now required to be very flexible yet elastic being required to bend convexly and concavely, yet springing back to their shape immediately, with some riders wanting stiff tips or soft tails or a combination of both.

16 Claims, 3 Drawing Sheets

PRODUCT FOR TRAVERSING SNOW

BACKGROUND OF INVENTION

This invention relates to the field of devices that are used to enable the user to slide or glide across surfaces such as snow and ice. The device that is particularly suited for this invention is a snowboard. As one skilled in the art will recognize, an application of this invention can extend further than just to the field of snowboarding, and as such would be covered by the concept and spirit of this invention.

DESCRIPTION OF THE ART

This invention accomplishes some of the attributes desirable for a user to have a device that contains both damping characteristics and a cantilever stiffening aspect in one device. It is desirable for those who participate in the activity of snowboarding to have a board that is soft or damping around the edges, which will keep the snowboard conforming to the terrain, while at the same time being able to have the snowboard "spring" back to its natural state after being bent in both directions around half-pipes, contours or steel pipe rails. Snowboarding is different from skiing as there is more demand for freestyle jumping and riding on the edge of the snowboard. Skiing demands more bending of the ski in a concave direction with extreme flexural characteristics, as skiers tend to ride moguls, contours and uneven terrain, seeking the ski to smoothly transition between valleys and peaks. Snowboarding on the other extreme has more jumps and skateboarding types of terrain where the snowboard needs to "grab" the surface, damping, but also need to provide "spring" or lift when jumping from the edge of half-pipes and rails. Also a snowboard is more likely to be subjected to flexural and compressive forces at the same time and then the opposite forces will be subjected on the board in the next immediate moments. Snowboards need to adapt to bending moments in both the vertical and horizontal planes which are constantly and rapidly changing.

The prior art for those devices which can be used for gliding across snow can generally be described as layering materials of various properties longitudinally along the vertical axis of the device. U.S. Pat. No. 4,412,687 issued to Andre on Nov. 1, 1983 discloses a ski that is laminated with high tensile strength materials, rods and filament bundles. The goal is to increase the rigidity and bending strength of the ski. U.S. Pat. No. 4,706,985 issued to Meatto on Nov. 17, 1987 also discloses the basic concept of layering materials to obtain the desired characteristic of the device. Meatto combines both circular rods and sheets of various components to increase flexural response and compressive structural strength of the ski. Snowboards though need to be soft and flexible not stiff as skis. The early snowboards were built as having the same internal material composition of skis. But as snowboarding developed into a different style of sport from skiing, the design of snowboards have started to develop to adapt to this change in use. The prior art of snowboard design has followed the designs of both skis and skateboards.

Snowboards have three distinct sections, the main body, the front tip or nose, and the rear tail. Each is shaped differently and in snowboards the tip and tail are significantly larger in width than is the body than in skis. Snowboards are ridden with the center of gravity of the user generally over the center of gravity of the snowboard, where on skis the center of gravity is shifted toward the tail of the ski. The skier faces the along the axis of motion, where the snowboarder is transverse to the axis of motion, needing a wider plane in order to attach themselves to the snowboard and creating the need for torsional movement rather than axial movement. Generally, this torsional movement is generated on the edge of the snowboard and thus snowboards are now built with this recognition of movement in mind. Prior art shows snowboards developing softer edge material so that the snowboard is easier to carve in long turns. Patent Publication 2002/0105165 for DeRocco published Aug. 8, 2002 details this concept of varying edge properties by using ABS or other relatively rigid materials in different shapes and thicknesses in the core of the board disclosing that some riders like a stiffer board. U.S. Pat. No. 6,499,758 issued to Fournier on Dec. 31, 2002, discloses a complex series of angles and grooves designed to reduce the compression forces necessary to bend the board. U.S. Pat. No. 6,382,658 issued to Stubblefield on May 7, 2002 discloses a plurality of cross-sections and thicknesses of the core to create an improved turning performance. These are both very complex to design and difficult to manufacture and thus they become very expensive and custom to a particular need of a rider in a particular situation, long smooth turns of Fournier to the sharp tight turns of Stubblefield. It would be desirable for a snowboard to be able to adapt to a multitude of different situations as they present themselves while snowboarding down a mountain slope. U.S. Pat. Nos. 6,520,530 and 6,105,991 issued to Dodge et al on Feb. 18, 2003 and Aug. 22, 2000 respectively, addresses the issue of having various directions of the strength of materials so that the material's direction of strength is located along the areas of greatest stress on the snowboard. This is very complex and arduous task of aligning materials for a particular style of riding. These patents claim vertically laminated members which are non-parallel to the core axis and anisotropic structures oriented so that the principal axis is not in alignment with any of the core axis. It would be desirable to produce a snowboard that is can be readily manufactured that would contain the positive attributes of the prior art such as varying degrees of flexibility and response but are more easily adaptable and manufacturable. It would be advantageous to be able to have a snowboard that combines the rider's desires as well as the demands of the conditions available for him to ride. It would be desirable to have a snowboard that is customizable in a short amount of time and can be mass produced for varying levels of ability and that uses the same concepts and materials.

This invention derives it's uniqueness from a combination of responsive materials and a cantilever inspired spring return system. The main uniqueness of this invention is that it treats the core, the tail and the tip as three separate entities which enable the invention to focus on the different materials necessary for each part of the board and yet function as a unit and have the different characteristics in the unique areas of the snowboard. The choice of materials is developed about the nature of the conditions during use and construction of the snowboard. Materials must have consistent properties through-out the manufacturing process including the cooler temperature when the snowboard is made and used, yet do not have their properties depreciated during the pressure, bending and heating processes during construction. Where flex is required in the tail and tip, a softer material is used, and while the core of the body is stiff for responsiveness, the edges are softer. The use of carbon fiber stiffening members "spring" the snowboard back to it's natural state quickly, so that the snowboard is ready to absorb the next grueling round of stresses around the next corner or half-pipe jump. This invention can be customizable by adjusting the stiffness of the snowboard by adding or subtracting stiffening members or by adjusting the thickness of the stiffening member.

DESCRIPTION OF FIGURES

The following figures are included to graphically detail the invention.

DETAILED DESCRIPTION OF THE INVENTION

Figure 1:
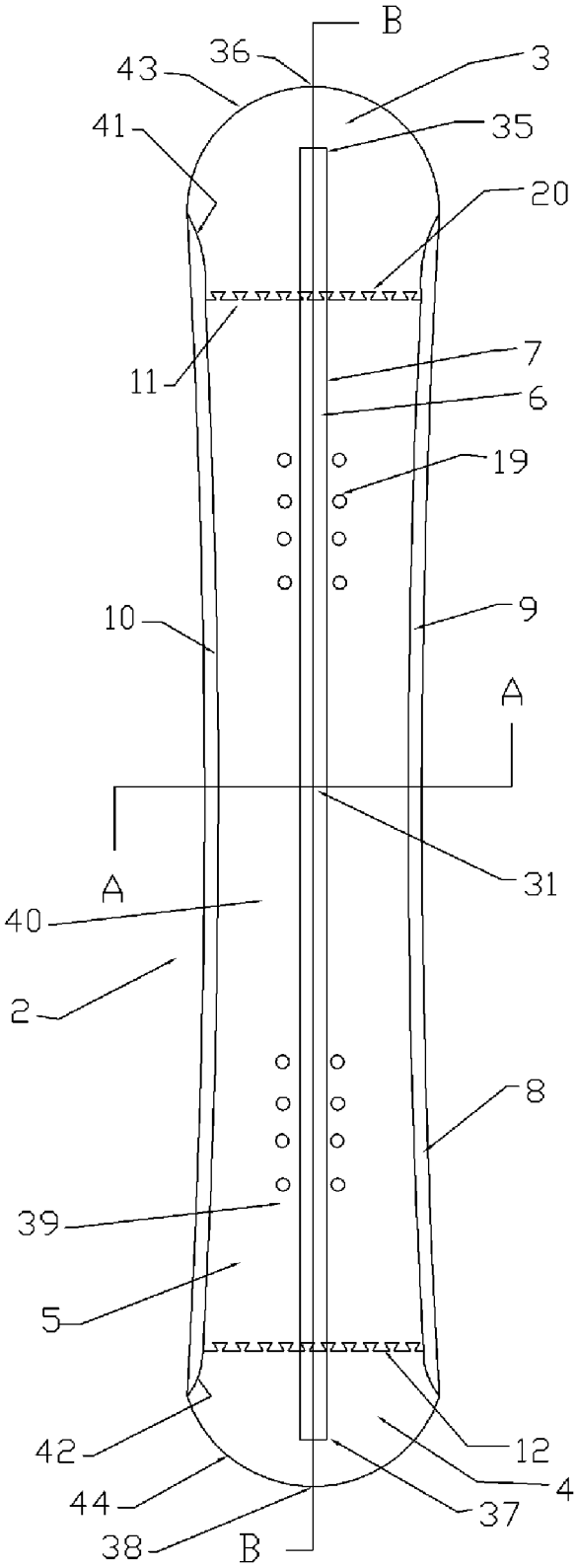
In FIG. 1, the interior core, tail and tip of the snowboard is shown.

In FIG. 1, the body 2 of the snowboard 1 is shown. Body 2 comprises tip 3, tail 4, core 5, at least 2 stiffening members 6, with an equal number of channel 7 corresponding to stiffening members 6, and perimeter edge 8. Core 5 is defined by right vertical plane wall 13 and left vertical plane wall 14 and upper horizontal plane wall 11 and lower horizontal plane wall 12. Core 5 is also defined by a front side of core 17 and a rear side of core 18 which extends in the horizontal plane between right vertical plane wall 13 and left vertical plane wall 14. Central riding surface 40 is defined as that area between the riders feet as they are attached via mountings holes 19 to the board 1, surface 40 extending from right vertical plane walls 13 through the vertical axis B-B to left vertical plane wall 14. Riding surface 40 is characterized as having an equal distance or thickness between front side 17 and rear side 18 at corresponding points through out core 5. Right edge 13 and left edge 14 are concavely circumscribed about an arc of a circle whose radii depends upon personal users preferences. Generally, a radius of approximately 1000 cm is used. Core 5 has a vertical axis of core B-B which is described as being the longitudinal line which is equidistant from corresponding points in the horizontal plane along said right edge 13 and said left edge 14. Vertical axis of core B-B is along the vertical axis of rotation. Core 5 has a horizontal axis of core A-A which a latitudinal line described as intersecting said vertical axis of core B-B at a right angle and is equidistant from corresponding points on upper horizontal plane wall 11 and lower horizontal plane wall 12. Midpoint 31 is defined as the intersection of vertical core axis B-B and horizontal core axis A-A. Front side of core 17 is has a reduction in thickness contour 32 tapered commencing at the distal end of mounting holes 39, tapering toward horizontal plane walls 11 and 12. The reduction of thickness along contour 32 extends at a constant rate creating an equal thickness of the core extending from right edge 13 and said left edge 14. Core 5 has a thickness at midpoint 31 of between 4-10 mm, preferable 6-8 mm. Core 5 has a thickness of between 1-6 mm at horizontal plane walls 11 and 12, preferably 2-4 mm. In this invention, core 5 follows contour 32 from 6 mm to 3 mm in thickness with a slight radius. Contour 32 can have a slope that contains a radius or has a straight slope toward its termination point at the horizontal walls. Tip 3 and tail 4 are joined with equal thickness to horizontal plane wall 11 and 12. Upper horizontal plane wall 11 and lower horizontal plane wall 12 are adapted for maximum bonding adhesion by increasing the surface area of the bond between core 5 and tip 3 and core 5 and tail 4. In this invention, a dovetail design 20 is used to accomplish this goal of maximum adhesion. This invention is not limited to a particular design to maximize the surface area for greater adhesion. The goal is to create the maximum necessary bond between said core 5 and tip 3 and core 5 and tail 4. Bonding means are used to enhance dovetail 20 adhesion to tip 3 and tail 4. The distance between said front side of core 17 and rear side of core 18 at any one point of core 5 is predetermined by the style of use of said board 1. This invention is not limited to specific contour angle or lack thereof. Binding mounting holes 19 are located along vertical axis of core B-B, corresponding to a predetermined pattern of inserts that are necessary for the attachment of bindings to said board 1 after completion of bonding of the layers. The pattern of inserts matches the configuration of mounting holes of the bindings, which usually conforms to the industry standards as for location and degree of angle of the mounting to the vertical axis of the snowboard. Binding mounting holes 19 are threaded inserts whose exterior is adapted for maximum adhesion during the bonding process in this invention. Core 5 can be made from wood, such as birch, aspen, balsa or other lightweight woods.

Right edge 13 and left edge 14 has circumscribed thereabout a perimeter edge 8. Perimeter 8 is equivalent in height as is the height of edge 13 and 14 and is bonded to edge 13 and 14 using bonding means. Perimeter edge 8 follows the radius of right edge 13 and left edge 14. Perimeter edge 8 extends in the horizontal plane a pre-determined distance based on desired board characteristics. Perimeter edge 8 is made of an isotropic material which is invariant with respect to any direction. This material must have stability of the characteristics throughout the range of temperatures for where board 1 is to be subjected thereto and also does not have any degradation of material characteristics when subjected to bonding means. In this invention, Celluarized or Expanded polyvinylchloride is used with of density of between 0.35 and 1 g/cm$^3$, preferably 0.55 to 0.75 g/cm$^3$. Perimeter 8 edge extends beyond upper horizontal plane wall 11 following tip cutin radius 41, terminating at the transition between the radii of right edge 13 and left edge 14 and the tip radius 43. Perimeter 8 edge extends beyond lower horizontal plane wall 12 following tail cutin radius 42, terminating at the transition between the radii of right edge 13 and left edge 14 and the tail radius 44 as seen in FIG. 1.

Tail 4 is defined by a distance from the lower horizontal plane wall 12 to the apex of tail radius 38. Tail 4 constructed of material similar in physical and thermal characteristics to the material used in perimeter edge 8 and is connected to tail cutin radius 42 using bonding means. Tail radius 44 is defined as the curvature needed to connect the termination of right edge 13 and left edge 14 to apex 38. Distance from lower horizontal plane wall 12 to apex 38 is determined by the bending characteristics desired of board 1 by the riders. In this invention, the distance is approximately 20-24 cm. Tail 4 contains at least one tail extension channel 37 which similar in shape and dimensions as channel 33 and constitutes a continuation of channel 33 from core 5 to tail 4. There will exist at least an equal number of tail extension channel 37 corresponding to top channel 33 and bottom channel 34 that exist on core 5. Tail extension channel 37 will vary in length depending upon the particular performance characteristics required of board 1. Tail extension channel 37 will vary from 50% to 90% of the distance from lower horizontal plane wall 12 to apex 38. The longer the channel, the stiffer the tail of the board, which is better for turning but not for jumping or rail-riding.

Tip 3 is defined by a distance from the upper horizontal plane wall 11 to the apex of tail radius 36. Tip 3 constructed of material similar in physical and thermal characteristics to the material used in perimeter edge 8 and is connected to tail cutin radius 41 using bonding means. Tail radius 43 is defined as the curvature needed to connect the termination of right edge 13 and left edge 14 to apex 36. Distance from upper horizontal plane wall 11 to apex 36 is determined by the characteristics of board 1 by the riders. In this invention, the distance is approximately 26-30 cm. Tip 3 contains at least one tip extension channel 35 which is similar in shape and dimensions as channel 33 on core 5 and constitutes a continuation of channel 33 from core 5 to tip 3. There will exist at least an equal number of tip extension channel 35 corresponding to top channel 33 and bottom channel 34 that exist on core 5. Tip extension channel 35 will vary in length depending upon the particular performance characteristics required of board 1. Tip extension channel 35 will vary from 50% to 90% of the distance from upper horizontal plane wall 11 to apex 36. The longer the channel, the stiffer the tip of the board, which is better for turning but not for jumping or rail-riding. Percentage distance for tip extension channel 35 and tail extension channel 37 can be and usually is different due to performance characteristics required by the individual board. This invention focuses on the ability to rapidly change the performance of the board easily and without costly manufacturing changes.

Figure 3:
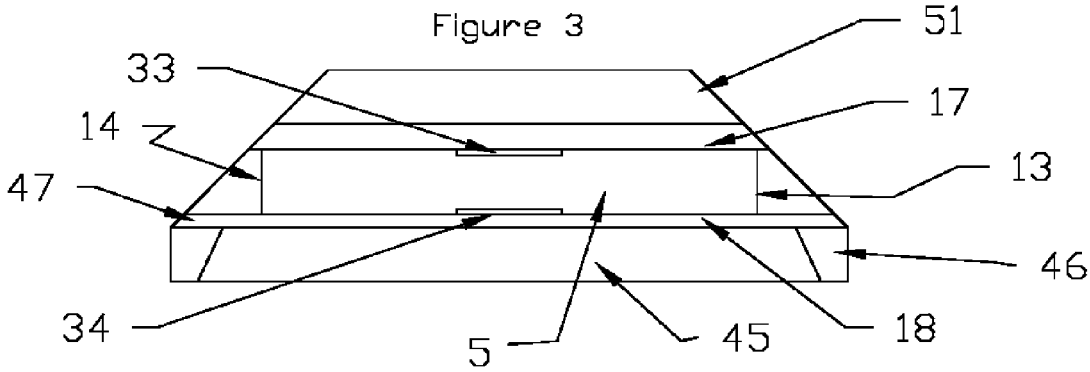
In FIG. 3, the snowboard is shown on a horizontal profile, cut along section A-A. In this figure, the snowboard is shown with only 1 stiffening member on each side of the core.
Figure 4:
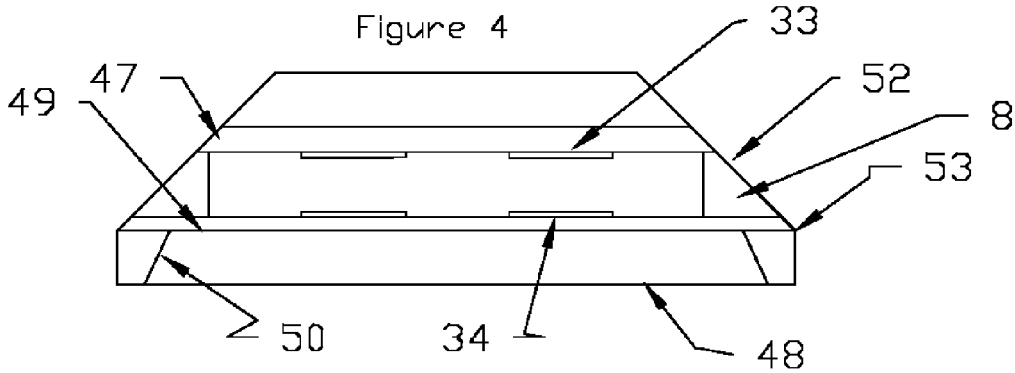
In FIG. 4, the snowboard is shown on a horizontal profile, cut along section A-A. In this figure, the snowboard is shown with 2 stiffening members on each side of the core, located equidistant from the vertical center of the board.
Figure 5:
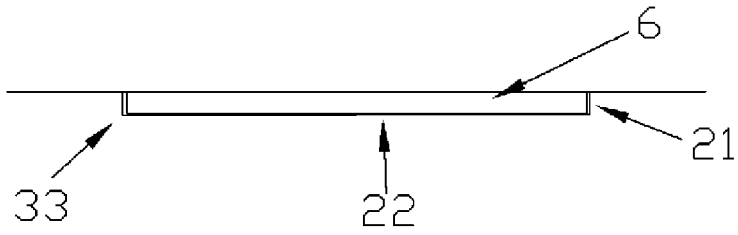
In FIG. 5, the detail of the stiffening member and associated channel is shown in profile view.
Figure 6:
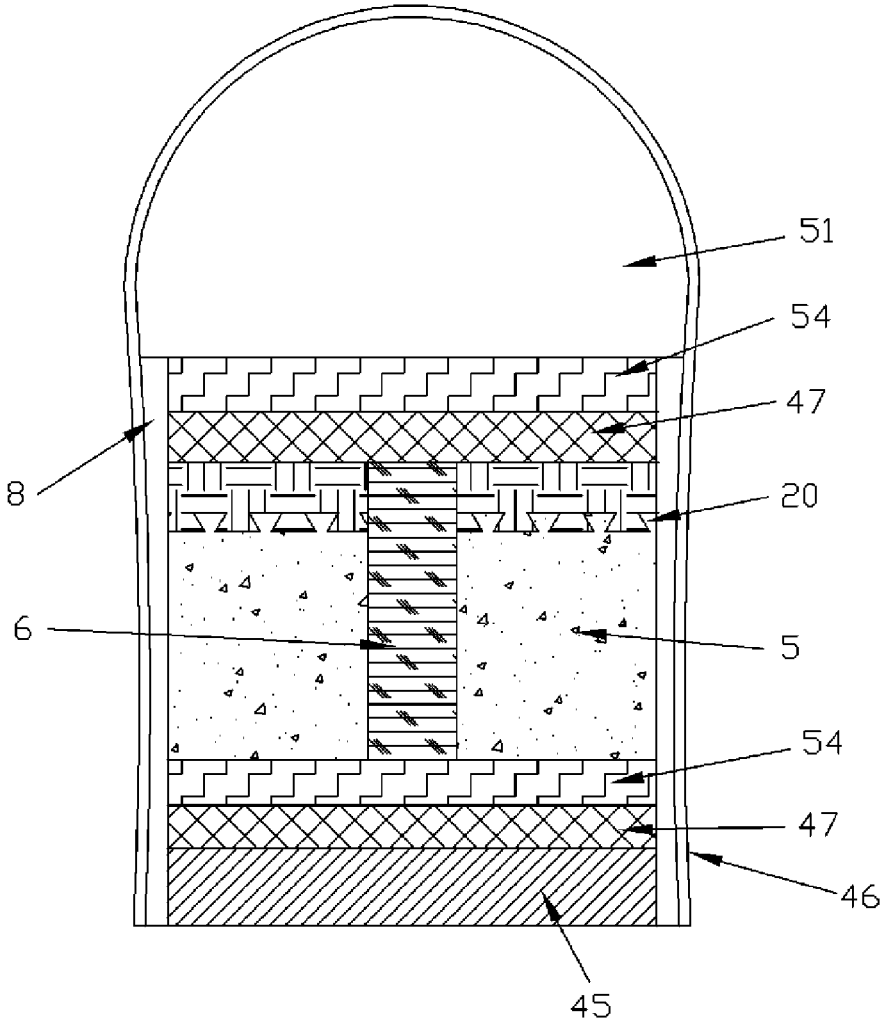
In FIG. 6, is a layered view of the snowboard, where each layer is shown by hatch pattern along with the stiffening member. Detail of the dovetail joint is also seen with this figure.

FIG. 5 details the channel and stiffening members. There are at least two channel 33 each having the depth equivalent to the thickness of stiffening member 6. FIG. 5 details just the upper half of core 5 for clarity. Channel 33 is defined by channel sides 21 and channel bottom 22. Stiffening member 6 is composed of a polymer based material with stiffening agents embedded therein, to produce a lightweight material with a high resistance of elastic deformation whereby the stiffening member will act like a piece of spring steel like material returning the member to it's original shape and size immediately after the action of deformation. Stiffening member 6 is placed directly onto channel bottom 22 and in proximal contact with channel sides 21. Bonding means is used to secure stiffening member 6 to channel sides 21. Channel 33 is milled or routed into the surface of core 5 as shown in FIGS. 3 and 4. FIG. 3 describes a top side channel 33 which contains two channel sides 21 that are perpendicular to front side of core 17 and a lower side channel 34 also contains two channel sides 21 that are perpendicular to rear side of core 18. In this embodiment of the invention that is detailed in FIG. 3, there is one top side channel 33 and one lower side channel 34, the horizontal center of each channel being located along the vertical axis of core B-B. The length of channel side 21 can be equal for top side channel 33 and lower side channel 34 or the length channel side 21 may be different between top side channel 33 and lower side channel 34, should the rider want to have a different rebound response between the flexation and compression of the stiffening members in the channels. For example, a rider who wishes to have board 1 that has a soft feel for trick riding, might wish to have a board that will bend more easily from the top of the board, but would wish for a stiffer bottom of the board to return or spring the board back to it's natural position. It is the characteristic of this invention to always have an equal number of said channel 33 inlaid on said front of core 17 and as there is channel 34 inlaid on said rear of core 18. FIG. 4 shows the addition of one top side channel 33 and one lower side channel 34 for a total of 2 on each side. In this embodiment of the invention, each front side channel is symmetrically placed about the vertical axis of core B-B. Each lower side channel is symmetrically placed about the vertical axis of core B-B directly opposite of the front side channel. It is the theory of this invention that the opposing forces supplied by the opposing stiffening members, one being in tension while the other is in compression, is what gives this invention the desired characteristics. This does not preclude the adaptation of variations in placement of the stiffening members in relation to one another, as that would be within the spirit of this invention. In this embodiment, said channel 33 in inlaid through the entire vertical distance of core 5 extending beyond said upper horizontal plane wall 11 and lower horizontal plane wall 12. It is within the spirit of this invention to reduce to length of said channel 33 to lengths less than that of the vertical distance of said core 5.

Core 5, in combination with bondly attached tip 3, tail 4 and perimeter edge 8 and along with bondly attached stiffening members 6, constitutes body 2. Body 2 is laminated to bottom layer 45 using bonding means. Bottom layer 45 is defined by upper bottom layer 49 and lower bottom layer 48 and bottom layer edge 50, bottom layer 45 being made of Ultra-High Molecular Weight polyethylene. Circumscribed about bottom layer edge 50 is metal carving extension rail 46 which is bondly attached to edge 50 using bonding means. Rail 46 is a flexible metallic piece that when sharpened after installation creates an edge that is able to carve into the solid ice facilitating turning of board 1 in icy conditions. The interface between edge 50 and rail 46 differs in shape corresponding to the type of rail 46 used. In this invention, FIGS. 3 and 4 describe a rail 46 which has an inclined angle, increasing the bonding surface area, which dictates the corresponding angle of edge 50. Bottom layer edge 50 with the bonded rail 46 proscribes a profile in the horizontal plane that conforms to the profile of body 2. Upper bottom layer 49, along with rail 46 is covered with bonding strengthening material 47 and bonding means. Body 2 is placed on top of upper bottom layer and accompanying bonding materials.

Figure 2:
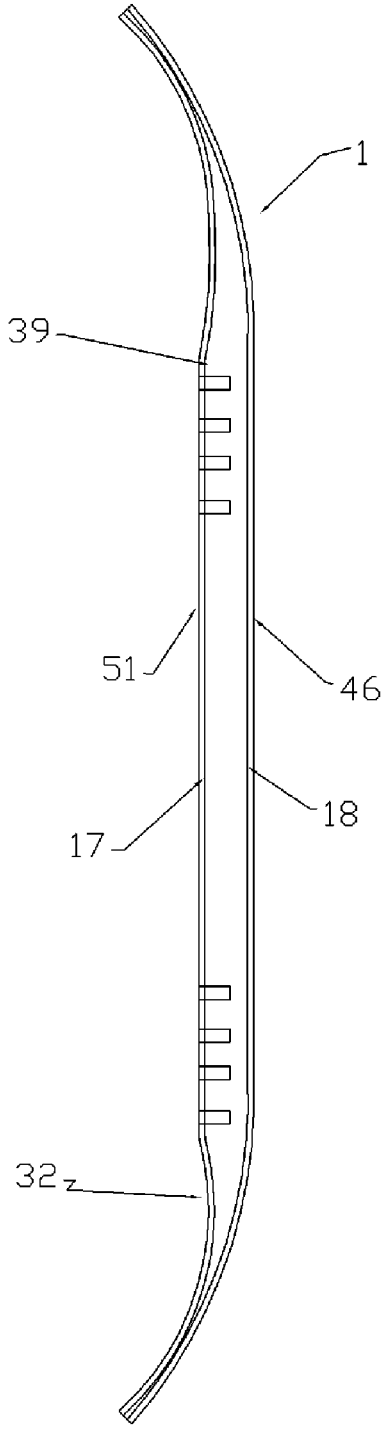
In FIG. 2, a profile of the snowboard is taken directly down the vertical centerline or section B-B as shown in FIG. 1. The entire snowboard is shown with the top and bottom layers along with the core.

Top layer 51 is profiled to match body 2. Top Layer 51 is modified to accept mounting holes 19. Body 2 is layered with bonding strengthening material 47 and bonding means and then top layer 51. Board 1 is then subjected to pressure and heat to cure the bonding material and to shape the vertical profile of the board as shown in FIG. 2. After cure, vertical edge angle 52 is produced. Grinding means are used to shape a 45 degree angle emanating from the upper outer corner 53 of rail 46, shaping the 45 degree angle in toward midpoint 31 along the entire outside surface of the rail 46. After processing the angle 52, board 1 is ready for final preparations for use. Bottom side of bottom layer 48 is roughed up using low grit sandpaper or similar device so that it is adapted to receive a waxing compound, which decreases friction between the board 1 and the snow. Upper layer of top layer 51 has applied thereupon multiple layers of liquid polymers, such as UV-stabilized acrylics, that will enhance the visual attributes of board 1 and will increase the surface hardness to prevent damage to the top layer of board 1.

Bonding means used in the construction of board 1 incorporate those characteristics which will provide superior adhesion of unlike materials, can be strengthened using bi-directional or omni-directional reinforcing materials, such as glass, carbon, metallic or similar natural or manmade fibers and can withstand temperature deviations typical where board 1 will be manufactured and used. In this invention, epoxy 54 is used as the bonding agent along with glass fiber mesh material, described as bonding strengthening material 47. The bonding material is subjected to heats up to 80 degrees Celsius and pressures up to 80 pounds per square inch during the curing process. The curing process is done in a press where the concave and convex shapes of the board are produced using opposing dies.

The invention claimed is:

1. A sliding device for traversing snow, defined in X-Y-Z planar relations where there exists a dimension of length X along a vertical axis, a dimension of width Y along the horizontal axis and a dimension of depth Z perpendicular to said horizontal axis and said vertical axis, comprising;

A core section, contoured by a set of longitudinal vertical plane walls defining the exterior vertical sides of said core, said vertical plane walls generated by equal radii, symmetrical about the vertical axis of said core, a set of latitudinal horizontal plane walls defining the horizontal ends of said core, said set of latitudinal horizontal plane walls consisting of an upper wall and a lower wall, said core consisting of a front side and a rear side, said core having a horizontal cross-section through said latitudinal horizontal axis of said core, said core having a vertical cross-section through said longitudinal vertical axis of said core, said core containing a riding surface located along said vertical axis, said vertical cross-section being reduced in thickness from said riding surface to said horizontal plane walls;

a first and a second perimeter edge contoured to said core located along each of said vertical plane walls, said perimeter edge having an interior side and an exterior side, said perimeter edge extends from said front side of said core to said rear side of said core;

a nose section, abutting to said upper wall of said horizontal plane walls, having a front side and a rear side, constructed of an isotropic material, said nose section having a distal and a proximal edge, said nose section extending from front said of core to rear side of said core, said distal edge of said nose section being circumscribed about a radius centered on said longitudinal vertical axis, said radius is larger than the horizontal distance between said longitudinal vertical axis and horizontal ends of said core a tail section, abutting to said lower wall of said horizontal plane walls, having a front side and a rear side, constructed of an isotropic material, said tail section having a distal and a proximal edge, said tail section extending from front side of said core to rear side of said core, said distal edge of said tip section being circumscribed about a radius centered on said longitudinal vertical axis;

at least one front channel, said front channel having a bottom and two sides, top of said sides are flush to said front side of said core, said front channel is inlaid longitudinally into said front side of said core, said front side of said nose and said front side of said tail;

at least one rear channel, said rear channel having a bottom and two sides, top of said sides are flush to said rear side of said core, said rear channel is inlaid longitudinally into said rear side of said core, said rear side of said nose and said rear side of said tail;

at least one front stiffening member, said front stiffening member having a top surface and a bottom surface, said front stiffening member being deposited into said front channel, such that said top surface of said front stiffening member is congruent to the surface of said front side of said core and said bottom surface of said front stiffening member is in contact with said bottom of said front channel, said front stiffening member shall extend from said lower end said front channel to said upper end of said front channel;

at least one rear stiffening member, said rear stiffening member having a top surface and a bottom surface, said rear stiffening member being deposited into said rear channel, such that said top surface of said rear stiffening member is congruent to the surface of said rear side of said core and said bottom surface of said rear stiffening member is in contact with said bottom of said rear channel, said rear stiffening member shall extend from said lower end of said rear channel to said upper end of said rear channel;

a bottom layer constructed of a polymer shaped to match contour of said core, said tip section, said nose section and said perimeter edge, said bottom layer having a top platform and a bottom platform, said bottom layer having a bottom layer edge along the perimeter of said bottom layer; and a top layer constructed of a colored UV-stabilized polymer shaped to match the contour of said core, said tip section, said nose section and said perimeter edge, said top layer having a top exposed cover and a lower unexposed cover, said top layer having an exterior edge circumscribed thereabout, said top layer is pre-disposed to accepting a pattern of threaded inserts.

2. A sliding device for traversing snow as in claim 1 where said perimeter edge is composed of an isotropic material and where said tip and said tail are also composed of an isotropic material with of density of between 0.35 and 1 g/cm$^3$.

3. A sliding device for traversing snow as in claim 1 where said proximal edge of said nose section is adapted for maximum surface area for bonding onto upper wall of horizontal end of said core and where said proximal edge of said tail section is adapted for maximum surface area for bonding onto said lower wall of horizontal end of said core.

4. A sliding device for traversing snow as in claim 3 where a dovetail pattern is used for said maximum surface area.

5. A sliding device for traversing snow as in claim 1 where the lower end of said inlaid front channel continues 10 to 90% of the total linear distance from said proximal edge to said distal edge of said front side of said tail section, the upper end of said inlaid front channel continues 10 to 90% of the total linear distance from said proximal edge to said distal edge of said front side of said nose section and where lower end of said inlaid rear channel inlaid continues 10 to 90% of total linear distance from said proximal edge to said distal edge of said rear side of said tail section, the upper end of said inlaid rear channel continues 10 to 90% of the total linear distance from said proximal edge to said distal edge of said rear side of said nose section.

6. A sliding device for traversing snow as in claim 1 where said front stiffening member and said rear stiffening member are constructed of polymer based material that contains an unbiased carbon based rigidity enhancement, wherein said unbiased carbon based rigidity enhancement is a material selected from the group consisting of uni-directional, bi-directional and omni-directional fibers.

7. A sliding device for traversing snow as in claim 6, where said rear stiffening member has the same thickness as said front stiffening member.

8. A sliding device for traversing snow as in claim 6, where said rear stiffening member has a different thickness as said front stiffening member.

9. A sliding device for traversing snow as in claim 1 where said bottom layer is constructed with an ultra high molecular weight polyethylene.

10. A sliding device for traversing snow as in claim 1 where said top layer is constructed of a colored UV-stabilized polymer selected from the group consisting of polybutylene terephthalate, acrylonitrile-butadiene-styrene copolymers, and ultra high molecular weight polyethylene.

11. A sliding device for traversing snow as in claim 1 where said core is made of a wood.

12. A sliding device for traversing snow as in claim 1 where said riding surface encompasses an area along said vertical axis, extending thereto each said vertical plane wall and extends symmetrically to a point about the horizontal axis to a distal end of said pattern of threaded inserts.

13. A sliding device for traversing snow as in claim 1 where said one front channel and one said rear channel in said vertical plane of said core is located upon said longitudinal axis.

14. A sliding device for traversing snow as in claim 1 where multiple said front channels and multiple said rear channels in said vertical plane of said core are located symmetrically about said longitudinal axis, said core containing an equal number of said front channels and said rear channels.

15. A sliding device for traversing snow as in claim 1 where said bottom layer has conformed thereabout its perimeter a metal carving extension rail, having an inclined interior face and a vertical exterior face perpendicular to said bottom layer.

16. A sliding device for traversing snow as in claim 1 where said exterior side of said perimeter edge and exterior edge of said top layer is beveled at 45 degrees.

* * * * *